United States Patent [19]

Abel

[11] 4,029,849

[45] June 14, 1977

[54] COVER SHEETS WITH TIMING LAYER COMPRISING CELLULOSE ACETATE AND COPOLYMER OF MALEIC ANHYDRIDE

[75] Inventor: Edward P. Abel, Webster, N.Y.

[73] Assignee: Eastman Kodak Company, Rochester, N.Y.

[22] Filed: Sept. 7, 1976

[21] Appl. No.: 720,726

Related U.S. Application Data

[62] Division of Ser. No. 521,221, Nov. 5, 1974, Pat. No. 4,009,030.

[52] U.S. Cl. ..... 428/500; 96/3; 96/29 D; 96/77; 428/507; 428/510; 428/515; 428/520; 428/532; 428/534

[51] Int. Cl.² ..... G03C 7/00; G03C 5/54; B44D 1/09; B44D 1/30

[58] Field of Search ..... 96/3, 29 D, 77; 428/507, 510, 520, 515, 532, 500, 534

[56] References Cited

UNITED STATES PATENTS

| | | | |
|---|---|---|---|
| 3,721,562 | 3/1973 | Land | 96/3 |
| 3,753,764 | 8/1971 | Haefner | 96/76 R |

FOREIGN PATENTS OR APPLICATIONS

| | | |
|---|---|---|
| 856,792 | 12/1960 | United Kingdom |

OTHER PUBLICATIONS

"Neutralizing Mat'l . . . Elements", *Research Disclosed* No. 12331 7/1974 pp. 22–24.

B351,673, Jan. 1975, Fleckenstein et al., 96/3.

*Primary Examiner*—David Klein
*Assistant Examiner*—Richard L. Schilling
*Attorney, Agent, or Firm*—Harold E. Cole

[57] ABSTRACT

Timing layer for color diffusion transfer assemblages comprises a mixture of cellulose acetate and a maleic anhydride copolymer with 2 to 20% by weight of the mixture being said copolymer.

6 Claims, No Drawings

COVER SHEETS WITH TIMING LAYER COMPRISING CELLULOSE ACETATE AND COPOLYMER OF MALEIC ANHYDRIDE

This is a division of application Ser. No. 521,221, filed Nov. 5, 1974 now U.S. Pat. No. 4,009,030.

This invention relates to photography and more particularly to color photography for color diffusion transfer assemblages wherein a novel timing layer is employed comprising a mixture of cellulose acetate and a maleic anhydride copolymer in a particular concentration range.

In color diffusion transfer assemblages, a "shutdown" mechanism is needed to stop development after a predetermined time, such as 20–60 seconds in some formats or up to three minutes in others. Since development occurs at a high pH, it can be stopped by merely lowering the pH. The use of a neutralizing layer such as a polymeric acid can be employed for this purpose which will stabilize the element after the required diffusion of dyes has taken place. A timing layer is employed in conjunction with the neutralizing layer so that the pH is not prematurely lowered which would stop development. The development time is thus established by the time it takes the alkaline composition to penetrate through the timing layer. As the system starts to become stabilized, alkali is depleted throughout the structure causing silver halide development to cease in response to this drop in pH. For each image-generating unit, this shutoff mechanism can establish the amount of silver halide development and the related amount of dye formed according to the respective exposure values.

Various formats for color diffusion transfer assemblages are described in the prior art such as U.S. Pat. Nos. 3,415,644; 3,415,645; 3,415,646; 3,647,437; 3,635,707; 3,756,815 and Canadian Pat. Nos. 928,559 and 674,082. In these formats, the image-receiving layer containing the photographic image for viewing can remain permanently attached and integral with the image generating and ancillary layers present in the structure when a transparent support is employed on the viewing side of the assemblage. The image is formed by dyes, produced in the image generating units, diffusing through the layers of the structure to the dye image-receiving layer. After exposure of the assemblage, an alkaline processing composition permeates the various layers to initiate development of the exposed photosensitive silver halide emulsion layers. The emulsion layers are developed in proportion to the extent of the respective exposures, and the image dyes which are formed or released in the respective image generating layers begin to diffuse throughout the structure. At least a portion of the imagewise distribution of diffusible dyes diffuse to the dye image-receiving layer to form an image of the original subject.

Other so-called "peel-apart" formats for color diffusion transfer assemblages are described, for example, in U.S. Pat. Nos. 2,983,606; 3,362,819; and 3,362,821. In those formats, the image-receiving element is separated from the photosensitive element after development and transfer of the dyes to the image-receiving layer.

Various timing layer materials are disclosed in an article in Research Disclosure 12331, Vol. 123, July, 1974, entitled "Neutralizing Materials in Photographic Elements". The list of materials disclosed includes cellulose derivatives, vinyl polymers, acrylate polymers, polyesters, polycarbonates, polyurethanes and mixtures thereof. One of the vinyl polymers disclosed includes a maleic anhydride copolymer treated to form an intramolecular ester-lactone. Use of the particular combination of materials in a particular concentration range as set forth in my invention is not disclosed in this reference, however.

Prior art patents relating to various timing layer materials include U.S. Pat. Nos. 3,362,819, 3,455,686, 3,415,644, 3,414,411, 3,785,815, 3,575,701, and British Pat. No. 1,340,349. The timing layer of my invention is not disclosed in these patents, however.

British Pat. No. 856,792 discloses the use of a mixture of cellulose acetate and a maleic anhydride copolymer in a diffusion transfer receiving sheet. The mixture is used in a nuclei layer, however, in a silver salt diffusion transfer receiving sheet and not as a timing layer for color diffusion transfer assemblages as in my invention. In addition, this patent also does not teach the specific concentration range of the mixture according to my invention.

U.S. Pat. No. 3,753,764 discloses the use of cellulose acetate as a timing layer in diffusion transfer receiving sheets. However, when a cellulose acetate timing layer is coated over a polymeric acid layer on a transparent color sheet for use in a color diffusion transfer process, certain problems become apparent when the cover sheet is aged. Upon incubation at elevated temperatures and humidity, the cellulose acetate timing layer of the cover sheet becomes steadily more resistant to alkaline hydrolysis and, therefore, less permeable to penetration by alkali. This results in a longer effective process time than desired before shutdown with a resulting gradual increase in Dmin, Dmax, and contrast of the released dye image in the dye image-receiving layer.

I have found that a timing layer which is stable upon aging can be produced by employing a mixture of cellulose acetate and a relatively small proportion of a maleic anhydride copolymer. The polymers are compatible to give a clear layer, and when used in the proper proportions and layer thickness can provide a timing layer which will reproducibly delay the neutralization of the alkaline processing composition by the polymeric acid layer without regard for storage conditions.

The maleic anhydride copolymer in the timing layer should be employed in a concentration of about 2 to about 20% by weight, depending somewhat on the other comonomer. A 5–10% concentration has been found to be particularly effective. The thickness of the timing layer should be such to provide a coverage of about 1 to about 5 grams/m$^2$.

The cellulose acetate employed in my invention will usually have acetyl contents of about 37–40% by weight, the 37% being substantially more permeable than the 40% acetyl. Mixed esters can also be employed such as cellulose acetate propionate, cellulose acetate butyrate, etc.

The maleic anhydride copolymer employed in my invention can be selected from a wide variety of materials so long as it is compatible with the cellulose acetate employed to provide a clear film. Particularly good results are obtained with poly(styrene-co-maleic anhydride), poly(ethylene-co-maleic anhydride), and poly(methyl vinyl ether-co-maleic anhydride).

A portion of the anhydride of the maleic anhydride copolymer used in this invention may also be hydrolyzed to the corresponding acid prior to use. For example, the poly(ethylene-co-maleic anhydride) used in Example 4 hereinafter was analyzed and found to contain 28 mole % maleic acid, 16 mole % maleic anhydride and 56 mole % ethylene. Similarly, a poly(styrene-co-maleic anhydride) employed in one of the examples hereinafter was analyzed and found to contain 8 mole % maleic anhydride, 7 mole % monomethyl maleate, 26 mole % maleic acid and 59 mole % styrene. It is seen, therefore, that the mole % of maleic anhydride in the copolymer can vary over a wide range, with about 5 to about 50% generally giving good results.

Relatively few polymers, particularly those containing acid groups are compatible with cellulose acetate in forming a clear layer. For example, a mixture of cellulose acetate with poly(butyl methacrylate-co-methacrylic acid) did not give a stabilized timing layer.

A photographic assemblage according to my invention comprises:

a. a support having thereon at least one photosensitive silver halide emulsion layer having associated therewith a dye image-providing material;
b. a dye image-receiving layer;
c. means for discharging an alkaline processing composition within the assemblage;
d. a neutralizing layer for neutralizing said alkaline processing composition after a predetermined time; and
e. a timing layer which is permeable by said alkaline processing composition after said predetermined time;

the assemblage containing a silver halide developing agent, and wherein the timing layer comprises a mixture of cellulose acetate and a maleic anhydride copolymer, said mixture comprising about 2 to about 20% by weight of said copolymer.

One embodiment of an assemblage of an integral negative-receiver color diffusion transfer film unit in which the timing layer of the invention can be employed on a cover sheet is disclosed in Canadian Pat. No. 928,559. In this embodiment, the support for the photosensitive element is transparent and is coated with the image-receiving layer, a light-reflective layer, an opaque layer, and photosensitive layers, having associated therewith dye image-providing material layers. A rupturable container containing an alkaline processing composition and an opacifier such as carbon black is positioned adjacent to the top layer and a transparent cover sheet. The cover sheet comprises a transparent support which is coated with a neutralizing layer and a timing layer of the invention. The film unit is placed in a camera, exposed through the transparent cover sheet and then passed through a pair of pressure-applying members in the camera as it is being removed therefrom. The pressure-applying members rupture the container and spread processing composition and opacifier over the image-forming portion of the assemblage to protect it from exposure. The processing composition develops each silver halide layer and dye images are formed as a result of development which diffuse to the image-receiving layer to provide a right-reading image which is viewed through the transparent support on the opaque reflecting layer background. The neutralizing layer then neutralizes the alkaline processing composition after the timing layer of the invention breaks down, thus "shutting off" the system. For further details concerning the format of this particular integral assemblage, reference is made to the above-mentioned Canadian Pat. No. 928,559, which is incorporated herein by reference.

Another embodiment of an assemblage of an integral color diffusion transfer film unit in which the timing layer of the invention can be employed in a dye image-receiving element is described in U.S. Pat. No. 3,415,644. In this embodiment, the negative comprises an opaque support which is coated with photosensitive layers having associated therewith dye image-providing material layers. A rupturable container containing an alkaline processing composition, $TiO_2$, and an indicator dye (see U.S. Pat. No. 3,647,437) is positioned adjacent the top layer and a transparent receiver. The receiver comprises a transparent support which is coated with a neutralizing layer, the timing layer of the invention, and an image-receiving layer. The film unit is placed in a camera, exposed through the transparent receiver and then passed through a pair of pressure-applying members in the camera as it is being removed therefrom. The pressure-applying members rupture the container and spread processing composition, $TiO_2$, and indicator dye over the image-forming portion of the assemblage to protect it from exposure. The processing composition develops each silver halide layer and dye images are formed as a result of development which diffuse to the image-receiving layer which is viewed through the transparent support on a white background—the indicator dye having "shifted" to a colorless form as the alkali is consumed by the neutralizing layer. As before, the neutralizing layer then neutralizes the alkaline processing composition after the timing layer of the invention breaks down to shut off the system. For further details concerning the format of this particular assemblage, reference is made to the above-mentioned U.S. Pat. No. 3,415,644, which is incorporated herein by reference. Since the image in this embodiment is geometrically reversed, an image-reversing optical system such as a mirror in the camera is needed to reverse the image so that a right-reading image is viewable in the dye image-receiving layer.

Another embodiment of an assemblage of a color diffusion transfer film unit in which the timing layer of the invention can be employed in a dye image-receiving element is described in U.S. Pat. No. 3,362,819. The image-receiving element comprises a support, which is usually opaque, having thereon a neutralizing layer, the timing layer of the invention and a dye image-receiving layer. For further details concerning the use of such an element in color transfer assemblages, reference is made to the above-mentioned U.S. Pat. No. 3,362,819, which is incorporated herein by reference.

Still other useful integral formats in which my invention can be employed are described in U.S. Pat. Nos. 3,415,645; 3,415,646; 3,647,437; 3,635,707; and British Pat. No. 1,330,524.

The photosensitive element useful in my invention can be treated with an alkaline processing composition to effect or initiate development in any manner. A preferred method for applying processing composition is by use of a rupturable container or pod which contains the composition. In general, the processing composition employed in my invention contains the developing agent for development, although the composition could also just be an alkaline solution where the developer is incorporated in the photosensitive element, in which case the alkaline solution serves to activate the incorporated developer.

The dye image-providing materials which may be employed in my invention generally may be characterized as either (1) initially soluble or diffusible in the processing composition but are selectively rendered nondiffusible in an imagewise pattern as a function of development, such as those disclosed, for example, in U.S. Pat. Nos. 2,647,049; 2,661,293; 2,698,244; 2,698,798; 2,802,735; 2,774,668; and 2,983,606; or (2) initially insoluble or nondiffusible in the processing composition but which are selectively rendered diffusible in an imagewise pattern as a function of development, such as those disclosed, for example, in U.S. Pats. Nos. 3,227,550; 3,227,551; 3,227,552; 3,227,554; 3,243,294; and 3,445,228. These materials may be preformed dyes or dye precursors, e.g., color couplers, oxichromic compounds and the like.

In a preferred embodiment of my invention the dye image-providing material is a nondiffusible redox dye releaser. Such compounds are, generally speaking, compounds which can be oxidized by oxidized developing agent, i.e., cross-oxidized, to provide a species which as a function of oxidation will release a diffusible dye, such as by alkaline hydrolysis. Such redox dye releasers are described in U.S. Pat. No. 3,725,062 of Anderson and Lum, issued Apr. 3, 1973; U.S. Pat. No. 3,698,897 of Gompf and Lum, issued Oct. 17, 1972; U.S. Pat. No. 3,628,952 of Puschel et al. issued Dec. 21, 1971; U.S. Pat. No. 3,443,939 of Bloom et al., issued May 13, 1969; U.S. Pat. No. 3,443,940 of Bloom et al., issued May 13, 1969; and the following copending applications: Ser. Nos. 351,673 of Fleckenstein et al., filed Apr. 16, 1973, and 351,700 of Fleckenstein, now U.S. Pat. No. 3,928,312; Ser. Nos. 331,727 and 331,729 of Landholm et al., both filed Feb. 12, 1973 now abandoned; Ser. 331,728 of Haase et al., filed Feb. 12, 1973, now abandoned; and Ser. No. 326,628 of Hinshaw et al. filed Jan. 26, 1973, the disclosures of which are hereby incorporated by reference.

In an especially preferred embodiment of my invention, the redox dye releasers in the Fleckenstein et al. application Ser. No. 351,673 referred to above are employed. Such compounds are nondiffusible sulfonamido compounds which are alkali-cleavable upon oxidation to release a diffusible dye from the benzene nucleus and have the formula:

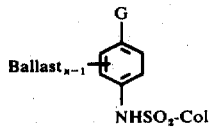

wherein:

1. Col is a dye or dye precursor moiety;
2. Ballast is an organic ballasting radical of such molecular size and configuration (e.g., simple organic groups or polymeric groups) as to render the compound nondiffusible during development in an alkaline processing composition;
3. G is OR or NHR$_1$ wherein R is hydrogen or a hydrolyzable moiety and R$_1$ is hydrogen or a substituted or unsubstituted alkyl group of 1 to 22 carbon atoms, such as methyl, ethyl, hydroxyethyl, propyl, butyl, secondary butyl, tert-butyl, cyclopropyl, 4-chlorobutyl, cyclobutyl, 4-nitroamyl, hexyl, cyclohexyl, octyl, decyl, octadecyl, docosyl, benzyl, phenethyl, etc., (where R$_1$ is an alkyl group of greater than 6 carbon atoms, it can serve as a partial or sole Ballast group); and
4. *n* is a positive integer of 1 to 2 and is 2 when G is OR or when R$_1$ is a hydrogen or an alkyl group of less than 8 carbon atoms.

For further details concerning the above-described sulfonamido compounds and specific examples of same, reference is made to the above-mentioned Fleckenstein et al. application Ser. No. 351,673 and Belgian Pat. No. 788,268, issued Feb. 28, 1972, the disclosures of which are hereby incorporated by reference.

Sulfonamido compounds which can be employed in my invention include the following:

Compound No. 1

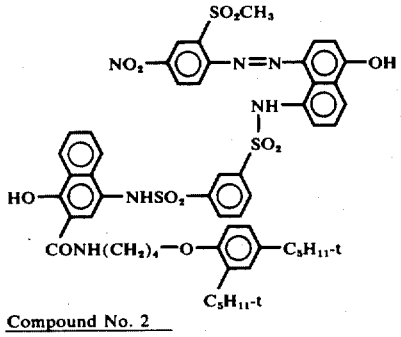

Compound No. 2

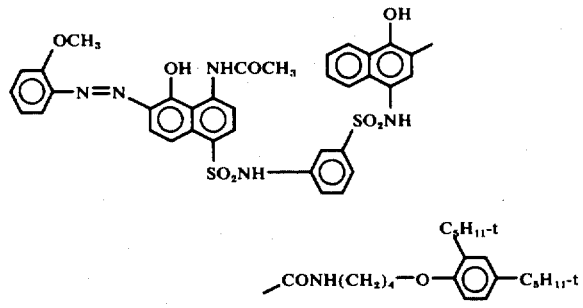

Compound No. 3

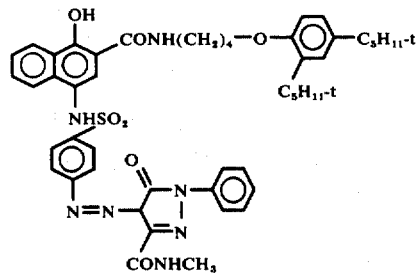

Compound No. 4 — 3-Pentadecyl-4-(p-phenylazobenzenesulfonamido)phenol

Compound No. 5 — 1-Hydroxy-4-(p-phenylazobenzenesulfonamido)-2-[-(2,4-di-tert-amylphenoxy)-n-butyl]-naphthamide Compound No. 6 — 8-Acetamido-3,6-disulfo-2-{p-[(4-hydroxy-2-pentadecyl)-phenylsulfamoyl]-phenylazo}-naphthol monopyridinium salt Compound No. 7 —{2- p- (4-Hydroxy-2-pentadecyl)-phenylsulfamoyl -phenylazo}-4-isopropoxynaphthol Compound No. 8 — 4{p-[4'-(N,N-Dimethylamino)-phenylazo]-benzenesulfonamido}-3-pentadecyl-phenol Compound No. 9 — 1-Hydroxy-4-[4-(1-hydroxy-4-isopropoxy-2-naphthylazo)-benzenesulfonamido]-2-[-(2,4-di-tert-amylphenoxy)-n-butyl]-naphthamide Compound No. 10 — 1 -Hydroxy-4-[3-(1-phenyl-3-methylcarbamyl-4-pyrazolin-5-onylazo)-benzenesulfonamido]-2-δ-(2,4-di-tert-amylphenoxy)-n-butyl]-naphthamide Compound No. 11 — 4-[p-(4'-Dimethylamino-phenylazo)-benzene-sulfonamido]-N-n-dodecylaniline Compound No. 12 — 3-Pentadecyl-4-(p-phenylazobenzenesulfonamido)-aniline Compound No. 13 — 1-(N-n-Dodecylamino)-4-(p-phenylazobenzenesulfonamido)-naphthalene Compound No.14 — 2-{p-[(4-amino-2-pentadecyl)-benzenesulfamyl]-phenylazo}-4-isopropoxynaphthol Compound No. 15 — 4-{p-[4 -(N',N'-dimethylamino)-phenylazo]-benzenesulfonamido}-3-octyl-N-ethylaniline Compound No. 16 — 5-{p- 4'-(N,N-Dimethylamino)-phenylazo]-benzenesulfonamido}-[-(N'-n-dodecylamino)-quinoline Compound No. 17 — Shifted Magenta Dye-Providing —1-Hydroxy-4-[3-(N-[4-(3,5-dibromo-4-hydroxy-phenylimino)-1-phenyl-2-pyrazolin-5-on-3-yl]carbamyl)-benzenesulfonamido]-2-[-(2,4-di-tert-amyl-phenoxy)-n-butyl]naphthamide Compound No. 18 — Cyan Dye-Providing (Initially Leuco)—1-Hydroxy-4-[3-(4-[3-chloro-5-(3,5-dichloro-4-hydroxyanilino)-2-hydroxy-4-methylaminolino]-6-hydroxy-s-triazinyl-2-amino)-benzenesulfonamido]-2-[-(2,4-di-tert-anylphenoxy)-n-butyl]-naphthamide In another preferred embodiment of my invention, initially diffusible dye image-providing materials are employed such as dye developers, including metal complexed dye developers such as those described in U.S. Pats. Nos. 3,453,107; 3,544,545; 3,551,406; 3,563,739; 3,597,200; 3,705,184; and oxichromic developers as described and claimed in my coworkers' Lestina and Bush U.S. patent application Ser. No. 308,869, filed Nov. 22, 1972, now U.S. Pat. No. 3,880,658 the disclosures of which are hereby incorporated by reference. When oxichromic developers are employed, the image is formed by the diffusion of the oxichromic developer to the dye image-receiving layer where it undergoes chromogenic oxidation to form an image dye.

The assemblage of the present invention may be used to produce positive images in single- or multicolors. In a three-color system, each silver halide emulsion layer of the film assembly will have associated therewith a dye image-providing material possessing a predominant spectral absorption within the region of the visible spectrum to which said silver halide emulsion is sensitive, i.e., the blue-sensitive silver halide emulsion layer will have a yellow dye image-providing material associated therewith, the green-sensitive silver halide emulsion layer will have a magenta dye image-providing material associated therewith, and the red-sensitive silver halide emulsion layer will have a cyan dye image-providing material associated therewith. The dye image-providing material associated with each silver halide emulsion layer may be contained either in the silver halide emulsion layer itself or in a layer contiguous to the silver halide emulsion layer.

The concentration of the dye image-providing materials that are employed in the present invention may be varied over a wide range depending upon the particular compound employed and the results which are desired. For example, the dye image-providing compounds may be coated as dispersions in layers by using coating solutions containing a ratio between about 0.25 and about 4 of the dye image-providing compound to the hydrophilic film-forming natural material or synthetic polymer binder, such as gelatin, polyvinyl alcohol, etc., which is adapted to be permeated by aqueous alkaline processing composition.

Any silver halide developing agent can be employed in my invention depending upon the particular chemistry system involved. The developer may be employed in the photosensitive element to be activated by the alkaline processing composition. Specific examples of developers which can be employed in my invention include:

hydroquinone
N-methylaminophenol
Phenidone (1-phenyl-3-pyrazolidinone)
Dimezone (1-phenyl-4,4-dimethyl-3-pyrazolidinone)
aminophenols
N-N-diethyl p-phenylenediamine
3-methyl-N,N-diethyl-p-phenylenediamine
N,N,N',N'-tetramethyl-p-phenylenediamine, etc.
4-hydroxymethyl-4-methyl-1-phenyl-3-pyrazolidinone, etc.

In using redox dye releaser compounds in my invention, the production of diffusible dye images is a function of development of the silver halide emulsions with a silver halide developing agent to form either negative or direct positive silver images in the emulsion layers. If the silver halide emulsion employed forms a direct positive silver image, such as a direct positive internal-image emulsion or a solarizing emulsion, which is developable in unexposed areas, a positive image can be obtained on the dye image-receiving layer when redox releasers are employed which release dye where oxidized. After exposure of the film unit, the alkaline processing composition permeates the various layers to initiate development in the exposed photosensitive silver halide emulsion layers. The developing agent present in the film unit develops each of the silver halide emulsion layers in the unexposed areas (since the silver halide emulsions are direct-positive one), thus causing the developing agent to become oxidized imagewise corresponding to the unexposed areas of the direct-positive silver halide emulsion layers. The oxidized developing agent then cross-oxidizes the redox dye releaser compound, the oxidized form of which either releases directly or undergoes a base-catalyzed reaction to release the preformed dyes or the dye precursors imagewise as a function of the imagewise exposure of each of the silver halide emulsion layers. At least a portion of the imagewise distributions of diffusible dyes or dye precursors diffuse to the image-receiving layer to form a positive image of the original subject.

Internal-image silver halide emulsions useful in the above-described embodiment are direct-positive emulsions that form latent images predominantly inside the silver halide grains, as distinguished from silver halide grains that form latent images predominantly on the surface thereof. Such internal-image emulsions were described by Davey et al. in U.S. Pat. No. 2,592,250 issued Apr. 8, 1952, and elsewhere in the literature. Other useful emulsions are described in U.S. Pat. No. 3,761,276 issued Sept. 25, 1973, U.S. Pat. No.

3,761,266 issued Sept. 25, 1973 and U.S. Pat. No. 3,761,267 issued Sept. 25, 1973. Internal-image silver halide emulsions can be defined in terms of the increased maximum density obtained when developed to a negative silver image with "internal-type" developers over that obtained when developed with "surface-type" developers. Suitable internalimage emulsions are those which, when measured according to normal photographic techniques by coating a test portion of the silver halide emulsion on a transparent support, exposing to a light-intensity scale having a fixed time between 0.01 and 1 second, and developing for 3 minutes at 20° C in Developer A below (internal-type developer) have a maximum density at least five times the maximum density obtained when an equally exposed silver halide emulsion is developed for 4 minutes at 20° C in Developer B described below (surface-type developer). Preferably, the maximum density in Developer A is at least 0.5 density unit greater than the maximum density in Developer B.

| | |
|---|---|
| **DEVELOPER A** | |
| Hydroquinone | 15 g. |
| Monomethyl-p-aminophenol sulfate | 15 g. |
| Sodium sulfite (desiccated) | 50 g. |
| Potassium bromide | 10 g. |
| Sodium hydroxide | 25 g. |
| Sodium thiosulfate | 20 g. |
| Water to make one liter. | |
| **DEVELOPER B** | |
| P-hydroxyphenylglycine | 10 g. |
| Sodium carbonate | 100 g. |
| Water to make one liter | |

The internal-image silver halide emulsions when processed in the presence of fogging or nucleating agents provide direct positive silver images. Such emulsions are particularly useful in the above-described embodiment. Suitable fogging agents include the hydrazines disclosed in Ives U.S. Pat. Nos. 2,588,982 issued Mar. 11, 1952, and U.S. Pat. No. 2,563,785 issued Aug. 7, 1951; the hydrazides and hydrazones disclosed in Whitmore U.S. Pat. No. 3,227,552 issued Jan. 4, 1966; hydrazone quaternary salts described in British Pat. No. 1,283,835 and U.S. Pat. No. 3,615,615; hydrazone containing polymethine dyes described in U.S. Pat. No. 3,718,470; or mixtures thereof. The quantity of fogging agent employed can be widely varied depending upon the results desired. Generally, the concentration of fogging agent is from about 0.4 to about 8 g per mole of silver in the photosensitive layer in the photosensitive element or from about 0.1 to about 2 grams per liter of developer if it is located in the developer. The fogging agents described in U.S. Pats. Nos. 3,615,615 and 3,718,470, however, are preferably used in concentrations of 0.5 to 10 mg per mole of silver in the photosensitive layer, Typical useful direct-positive emulsions are disclosed in U.S. Pats. No. 3,227,552 by Whitmore issued Jan. 4, 1966; U.S. Pat. No. 3,761,276 by Evans issued Sept. 25, 1973; U.S. Pat. No. 3,761,267 by Gilman et al.; U.S. Pat. No. 3,761,266 by Milton; U.S. Pat. No. 3,703,584 by Motter, and the like.

In other embodiments, the direct-positive emulsions can be emulsions which have been fogged either chemically or by radiation on the surface of the silver halide grains to provide for development to maximum density without exposure. Upon exposure, the exposed areas do not develop, thus providing for image discrimination and a positive image. Silver halide emulsions of this type are very well-known in the art and are disclosed, for example, in U.S. Pats. No. 3,367,778 by Berriman issued Feb. 6, 1968, and U.S. Pat. Nos. 3,501,305, 3,501,306 and 3,501,307 by Illingsworth, all issued Mar. 17, 1970.

In still other embodiments, the direct-positive emulsions can be of the type described in Mees and James, *The Theory of the Photographic Process*, published by MacMillan Co., New York, N.Y., 1966, pp. 149–167.

The various silver halide emulsion layers of a color film assembly of the invention can be disposed in the usual order, i.e., the blue-sensitive silver halide emulsion layer first with respect to the exposure side, followed by the green-sensitive and red-sensitive silver halide emulsion layers. If desired, a yellow dye layer or a yellow colloidal silver layer can be present between the blue-sensitive and green-sensitive silver halide emulsion layer for absorbing or filtering blue radiation that may be transmitted through the blue-sensitive layer. If desired, the selectively sensitized silver halide emulsion layers can be disposed in a different order, e.g., the blue-sensitive layer first with respect to the exposure side, followed by the red-sensitive and green-sensitive layers.

The rupturable container employed in this invention can be of the time disclosed in U.S. Pat. Nos. 2,543,-181; 2,643,886; 2,653,732; 2,723,051; 3,056,492; 3,056,491; and 3,152,515. In general, such containers comprise a rectangular sheet of fluid-and air-impervious material folded longitudinally upon itself to form two walls which are sealed to one another along their longitudinal and end margins to form a cavity in which processing solution is contained.

In a color photographic assemblage according to this invention, each silver halide emulsion layer containing a dye image-providing material or having the dye image-providing material present in a contiguous layer may be separated from the other silver halide emulsion layers in the negative portion of the film unit by materials including gelatin, calcium alginate, or any of those disclosed in U.S. Pat. No. 3,384,483, polymeric materials such as polyvinylamides as disclosed in U.S. Pat. No. 3,421,892, or any of those disclosed in French Pat. No. 2,028,236 or U.S. Pat. Nos. 2,992,104; 3,043,692; 3,044,873; 3,061,428; 3,069,263; 3,069,264; 3,121,011 and 3,427,158.

Generally speaking, except where noted otherwise, the silver halide emulsion layers in the invention comprise photosensitive silver halide dispersed in gelatin and are about 0.6 to 6 microns in thickness; the dye image-providing material are dispersed in an aqueous alkaline solution-permeable polymeric binder, such as gelatin, as a separate layer about 1 to 7 microns in thickness; and the alkaline solution-permeable polymeric interlayers, e.g., gelatin, are about 1 to 5 microns in thickness. Of course, these thicknesses are approximate only and can be modified according to the product desired.

The alkaline solution-permeable, light-reflective layer employed in certain embodiments of photographic assemblages of my invention can generally comprise any opacifier dispersed in a binder as long as it has the desired properties. Particularly desirable are white light-reflective layers since they would be esthetically pleasing backgrounds on which to view a transferred dye image and would also possess the optical properties desired for reflection of incident radiation.

Suitable opacifying agents include titanium dioxide, barium sulfate, zinc oxide, barium stearate, silver flake, silicates, alumina, zirconium oxide, zirconium acetate, sodium zirconium sulfate, kaolin, mica, or mixtures thereof in widely varying amounts depending upon the degree of opacity desired. The opacifying agents may be dispersed in any binder such as an alkaline solution-permeable polymeric matrix, such as, for example, gelatin, polyvinyl alcohol, and the like. Brightening agents such as the stilbenes, coumarins, triazines and oxazoles can also be added to the light-reflective layer, if desired. When it is desired to increase the opacifying capacity of the light-reflective layers, dark-colored opacifying agents, e.g., pH-indicator dyes, may be added to it, or carbon black, nigrosine dyes, etc.,may be coated in a separate layer adjacent the light-reflective layer.

The neutralizing layer employed in my invention which becomes operative after permeation of the processing composition through the timing layer will effect a reduction in the pH of the image layers from about 13 or 14 to at least 11 and preferably 5–8 within a short time after imbibition. For example, polymeric acids as disclosed in U.S. Pat. No. 3,362,819 or solid acids or metallic salts, e.g., zinc acetate, zinc sulfate, magnesium acetate, etc., as disclosed in U.S. Pat. No. 2,584,030 may be employed with good results. Such neutralizing or pH-lowering materials reduce the pH of the film unit after development to terminate development and substantially reduce further dye transfer and thus stabilize the dye image.

Any material can be employed as the image-receiving layer in this invention as long as the desired function of mordanting or otherwise fixing the dye images will be obtained. The particular material chosen will, of course, depend upon the dye to be mordanted. if acid dyes are to be mordanted, the image-receiving layer can contain basic polymeric mordants such as polymers of amino guanidine derivatives of vinyl methyl ketone such as described in Minsk U.S. Pat. No. 2,882,156 issued Apr. 14, 1959, and basic polymeric mordants such as described in U.S. Pat. Nos. 3,709,690 and 3,625,694 and U.S. patent application Ser. No. 400,778 of Cohen et al. filed Sept. 26, 1973, now U.S. Pat. No. 3,898,088 and Ser. No. 412,992 of Burness et al filed Nov. 5, 1973 now U.S. Pat. No. 3,859,096. Other mordants useful in my invention include poly-4-vinylpyridine, the 2-vinyl pyridine polymer metho-p-toulene sulfonate and similar compounds described in Sprague et al. U.S. Pat. No. 2,484,430 issued Oct. 11, 1949, and cetyl trimethylammonium bromide, etc. Effective mordanting compositions are also described in Whitmore U.S. Pat. No. 3,271,148 and Bush U.S. Pat. No. 3,271,147, both issued Sept. 6, 1966.

Other materials useful in the dye image-receiving layer include alkaline solution-permeable polymeric layers such as N-methoxymethyl polyhexylmethylene adipamide; partially hydrolyzed polyvinyl acetate; and other materials of a similar nature. Generally, good results are obtained when the image-receiving layer, preferable alkaline solution-permeable, is transparent and about 0.25 to about 0.40 mil in thickness. This thickness, of course, can be modified depending upon the result desired. The image-receiving layer can also contain ultraviolet absorbing materials to protect the mordanted dye images from fading due to ultraviolet light, brightening agents such as the stilbenes, coumarins, triazines, oxazoles, dye stabilizers such as the chromanols, alkylphenols, etc.

The alkaline processing composition employed in this invention is the conventional aqueous solution of an alkaline material, e.g., sodium hydroxide, sodium carbonate or an amine such as diethylamine, preferably possessing a pH in excess of 11, and preferably containing a developing agent as described previously. The solution also preferably contains a viscosity-increasing compound such as a high-molecular-weight polymer, e.g., a water-soluble ether inert to alkaline solutions such as hydroxyethyl cellulose or alkali metal salts of carboxymethyl cellulose such as sodium carboxymethyl cellulose. A cencentration of viscosity-increasing compound of about 1 to about 5% by weight of the processing composition is preferred which will impart thereto a viscosity of about 100 cps. to about 200,000 cps. In certain embodiments of my invention, an opacifying agent, e.g., $TiO_2$, carbon black, indictor dyes, etc., may be added to the processing composition. In addition, ballasted indicator dyes and dye precursors may also be present in the photographic assemblage as a separate layer on the exposure side of the photosensitive layers; the indictor dyes being preferably transparent during exposure and becoming colored or opaque after contact with alkali from the processing composition.

The supports for the photographic elements of this invention can be any material as long as it does not deleteriously effect the photographic properties of the film unit and is dimensionally stable. Typical flexible sheet materials include cellulose nitrate film, cellulose acetate film, poly(vinyl acetal) film, polystyrene film, poly(ethyleneterephthalate) film, polycarbonate film, poly-$\alpha$-olefins such as polyethylene and polypropylene film, and related films or resinous materials. The support is usually about 2 to 9 mils in thickness. Ultraviolet absorbing materials may also be included in the supports or as a separate layer on the supports if desired.

The silver halide emulsions useful in may invention are well-known to those skilled in the art and are described in *Product Licensing Index*, Vol. 92, December, 1971, publication 9232, p. 107, paragraph I, "Emulsion types"; they may be chemically and spectrally sensitized as described on p. 107, paragraph III, "Chemical sensitization", and pp. 108–109, paragraph XV, "Spectral sensitization", of the above article; they can be protected against the production of fog and can be stabilized against loss of sensitivity during keeping by employing the materials described on p. 107, paragraph V, "Antifoggants and stabilizer", of the above article; they can contain development modifiers, hardeners, and coating aids as described on pp. 107–108, paragraph IV, "Development modifiers"; paragraph VII, "Hardeners"; and paragraph CII, "Coating aids", of the above article; they and other layers in the photographic elements used in this invention can contain plasticizers, vehicles and filter dyes described on p. 108, paragraph XI, "Plasticizers and lubricants", and paragraph VIII, "Vehicles", and p. 109, paragraph XVI, "Absorbing and filter dyes", of the above article; they and other layers in the photographic elements used in this invention may contain addenda which are incorporated by using the procedures described on p. 109, paragraph XVII, "Methods of addition", of the above article; and they can be coated by using the various techniques described on p. 109, paragraph XVIII, "Coating procedures", of the above article, the disclosures of whch are hereby incorporated by reference.

The following examples further illustrate the invention.

EXAMPLE 1

Timing Layer Permeability

Processing cover sheets were prepared by coating the following layers on a transparent poly(ethylene terephthalate) film support:

a.
1. polymeric acid layer of poly(acrylic acid) at 15.5 g/m²
2. timing layer of cellulose acetate (40% acetyl) at 0.65 g/m² b. similar to (a) except that layer 2 was a mixture of 95% cellulose acetate (40% acetyl) and 5% poly(styrene-co-maleic anhydride) (SMA) at 2.05 g/m² (intended composition of approximately 50 mole% of each monomer; however the styrene usually predominates by several %)

These cover sheets were employed as described below (1) after about one day at ambient temperature after coating and (2) after an additional 3-day incubation at 60° C and 70% RH.

The effectiveness of the timing layer in the cover sheet was measured by determining the time required to reduce the pH of a simulated integral film unit to pH 10 as measured by the color change from blue to colorless of an indicator dye, thymolphthalein. The dye was contained in a simulated integral element which consisted of the following successive layers coated on a polyester film support: (1) a mordant layer of a 2:1 mixture of poly[styrene-co-N-butyl-N,N-dimethyl-N-(3-maleimidopropyl)ammonium chloride] and gelatin, respectively, at 3.2 g/m²; (2) a reflective pigment layer of titanium dioxide in gelatin, at 21.5 and 2.15 g/m², respectively; (3) a gelatin layer at 1.7 g/m²; 4) a gelatin layer (5.4 g/m²) containing thymolphthalein indicator dye (215 mg/m²). The processing composition described below was employed in a pod and spread between the simulated element containing the indicator dye and each sample of the cover sheet by passing the "sandwich" between a pair of juxtaposed pressure rollers so that the developer layer thickness was 0.1 nm.

| PROCESSING COMPOSITION | |
|---|---|
| Sodium hydroxide | 60.0 g |
| 4-hydroxymethyl-4-methyl-1-phenyl-3-pyrazolidinone | 8.0 g |
| 5-methylbenzotriazole | 0.8 g |
| t-butylhydroquinone | 0.8 g |
| potassium iodide | 10.0 mg |
| sodium sulfite (anhyd.) | 2.0 g |
| hydroxyethylcellulose | 25.0 g |
| Distilled water to | 1.0 l. |

The time required for the pH of each laminate to drop below 10 as measured by the color change of the indicator dye is shown in Table I. The time given is the average of the time when the indicator dye begins to decolorize and the time when the dye is completely decolorized as determined by visual observation.

TABLE I

| Timing Layer | Coverage (g/m²) | Timing (seconds) Fresh | Timing (seconds) Incubated | % Increase |
|---|---|---|---|---|
| a) cellulose acetate (control) | 0.65 | 120 | 480 | 300 |
| b) cellulose acetate plus SMA | 2.05 | 90 | 110 | 22 |

The incubated cover sheet containing the cellulose acetate timing layer required four times as long to neutralize the film unit than the fresh one. Although the 95/5 polymer mixture was more permeable and a thicker layer was necessary for a comparable neutralization time, the layer was only slightly less permeable after incubation.

EXAMPLE 2

Timing Layer Effect on Sensitometry

The same cover sheets of Example 1 were used for processing a multicolor photosensitive element which had been exposed to a graduated density multicolor test object. The photosensitive element was of the type described in Example 41 of Fleckenstein et al. U.S. Pat. application Ser. No. 351,673 (corresponding French Pat. No. 2,154,443 issued May 1, 1973) The processing composition of Example 1 was employed in a pod as spread as in Example 1 to the same thickness.

After 3 hours, the following sensitometric results were read from the image-receiving side of the laminate.

TABLE II

| Timing Layer | Test | Dmax Red | Dmax Green | Dmax Blue | Dmin Red | Dmin Green | Dmin Blue |
|---|---|---|---|---|---|---|---|
| a) cellulose acetate (control) | Fresh | 2.48 | 2.30 | 1.92 | 0.34 | 0.32 | 0.25 |
| | Incubated | 2.72 | 2.62 | 2.20 | 0.44 | 0.42 | 0.32 |
| | Increase on Inc. | +0.24 | +0.32 | +0.28 | +0.10 | +0.10 | +0.07 |
| b) cellulose acetate plus SMA | Fresh | 1.90 | 1.94 | 1.64 | 0.30 | 0.30 | 0.22 |
| | Incubated | 2.00 | 2.00 | 1.68 | 0.30 | 0.30 | 0.24 |
| | Increase on Inc. | +0.10 | +0.06 | +0.04 | 0 | 0 | +0.02 |

Because cover sheet (a) with the cellulose acetate timing layer becomes less permeable on incubation, a longer time is required to reduce the pH and to shut down the dye-releasing process. The prolonged dye release and diffusion to the image-receiving layer results in a substantial increase in Dmax and Dmin. Little change occurs on incubation of the cover sheet having the timing layer of the polymer mixture.

EXAMPLE 3

Effect of Polymer Composition

A series of cover sheets were prepared as in Example 1 in which the composition of the timing layer varied from 0 to 20% poly(styrene-co-maleic anhydride) (SMA), the rest being cellulose acetate (40 percent acetyl). The timing layer was coated at the coverages listed below over a poly(acrylic acid) layer as in Example 1. The cover sheets were processed with the indicator sheet as in Example 1 and the average times required to reduce the pH below 10 are recorded in Table III. The processing composition, essentially as in Example 1, was spread at 0.1 mm thickness.

TABLE III

| Timing Layer Wt. % SMA | Polymer Composition Series Coverage (g/m²) | Timing (Seconds) Fresh | Incubated* | % Increase |
|---|---|---|---|---|
| 0 | 2.15 | 150 | 600 | 300 |
| 1 | 2.15 | 135 | 450 | 230 |
| 2 | 2.15 | 130 | 310 | 140 |
| 3 | 2.15 | 110 | 225 | 105 |
| 4 | 2.15 | 110 | 200 | 80 |
| 5 | 2.15 | 100 | 195 | 95 |
| 10 | 2.15 | 45 | 60 | 33 |
| 10 | 4.30 | 75 | 75 | 0 |
| 10 | 6.50 | 90 | 90 | 0 |
| 20 | 10.80 | 150 | 135 | 10 (decrease) |

*Incubated for 1 day at 60° C and 70% relative humidity.

The data show that the increase in SMA in the timing layer composition increases it permeability in the fresh coatings. The decrease in permeability of each timing layer on incubation becomes much less significant as the percentage of SMA increases.

EXAMPLE 4

Polymer Variation

Two cover sheets were prepared as in Example 1 in which the poly(styrene-co-maleic anhydride) in the cellulose acetate timing layer was replaced with another maleic anhydride polymer, poly(ethylene-co-maleic anhydride) (EMA) (Monsanto DX-840-21), also at the 5% level. Each timing layer was coated at 4.3 g/m² over a polyacrylic acid layer as in Example 1. The cover sheets were processed as in Example 1 to give the following results:

TABLE IV

| Timing Layer | Polymer Comparison Timing (Seconds) Fresh | Incubated* | % Increase |
|---|---|---|---|
| 5% EMA | 85 | 90 | 6 |

TABLE IV-continued

| Timing Layer | Polymer Comparison Timing (Seconds) Fresh | Incubated* | % Increase |
|---|---|---|---|
| 5% SMA | 180 | 210 | 17 |

*Incubated for 7 days at 49° C and 90% relative humidity.

The 95/5 cellulose acetate-EMA timing layer was considerably more permeable than the cellulose acetate-SMA layer. In each case, however, there was only a slight increase in the timing on incubation. By varying the concentration or layer thickness of the cellulose acetate-EMA layers, timing can be adjusted as with the cellulose acetate-SMA lyaers, timing can be adjusted as with the cellulose acetate-SMA layers described earlier.

The invention has been described in detail with particular reference to certain preferred embodiments thereof, but it will be understood that variations and modifications can be effected with the spirit and scope of the invention.

I claim:

1. In a cover sheet comprising a transparent support having thereon in order a neutralizing layer and a timing layer, the improvement comprising employing as said timing layer a compatible mixture of cellulose acetate and a maleic anhydride copolymer to provide a clear layer, said mixture comprising about 2 to about 20% by weight of said copolymer.

2. The cover sheet of claim 1 wherein said copolymer comprises poly(styrene-co-maleic anhydride).

3. The cover sheet of claim 2 wherein said mixture comprises about 5 to about 10% by weight of said copolymer.

4. The cover sheet of claim 1 wherein said copolymer comprises poly(ethylene-co-maleic anhydride).

5. The cover sheet of claim 4 wherein said mixture comprises about 5 to about 10% by weight of said copolymer.

6. The cover sheet of claim 1 wherein said copolymer comprises poly(methyl vinyl ether-co-maleic anhydride).

* * * * *